United States Patent [19]

Pinkerton

[11] 4,256,257

[45] Mar. 17, 1981

[54] AUTOMATIC CHIMNEY CAP

[76] Inventor: Carl A. Pinkerton, 6093 Northgap Rd., Columbus, Ohio 43229

[21] Appl. No.: 54,179

[22] Filed: Jul. 2, 1979

[51] Int. Cl.[3] ..... G05D 23/00; F23L 11/00; F23L 17/02

[52] U.S. Cl. ..... 236/1 G; 236/93 R; 98/59; 126/285.5; 126/285 B

[58] Field of Search ..... 236/1 G, 93; 98/58, 98/59, 122; 126/285.5, 285 B

[56] References Cited

U.S. PATENT DOCUMENTS

| | | | |
|---|---|---|---|
| 972,378 | 10/1910 | Huffman et al. | 98/59 |
| 1,375,248 | 4/1921 | Burke | 126/285.5 |
| 2,372,707 | 4/1945 | Blome | 98/58 X |
| 2,771,834 | 11/1956 | Goudy | 98/59 |
| 3,010,451 | 11/1961 | Hodgins | 126/285 |
| 3,101,039 | 8/1963 | Duchene et al. | 98/59 |
| 3,545,365 | 12/1970 | Snader | 98/59 |
| 3,730,112 | 5/1973 | Hutchinson et al. | 110/8 R |
| 3,773,028 | 11/1973 | Schreibeis | 126/285 |
| 3,921,509 | 11/1975 | Curry et al. | 98/59 |
| 3,945,307 | 3/1976 | Lyemance | 98/60 |
| 4,007,730 | 2/1977 | Heebink | 98/59 X |
| 4,020,754 | 5/1977 | Dalsin et al. | 98/59 |
| 4,046,318 | 9/1977 | Ripley | 236/1 G |

FOREIGN PATENT DOCUMENTS

| | | | |
|---|---|---|---|
| 2519897 | 11/1976 | Fed. Rep. of Germany | 98/59 |

*Primary Examiner*—William E. Wayner
*Assistant Examiner*—Harry Tanner
*Attorney, Agent, or Firm*—Thomas E. Beall, Jr.

[57] ABSTRACT

A chimney cap for closing and venting, selectively, the upper end of the chimney is manually controlled by means of chains or the like from a combustion area, particularly a fireplace, through counterweights and pulleys. Automatic control is determined by a smoke, heat, or incipient fire detector that will operate a hold relay to produce a signal split between a reset timer and double-throw, double-pull switch that is in turn operated by the position of the cap to operate a reversible motor for movement of the cap to its upper vented position upon the detection of combustion products within the chimney. Movement of the cap to its upper position will shield the detector and other electronics from combustion products, and after a timed period, the reset timer will actuate the motor to move the cap to its closed position where it will remain unless the detector again detects the presence of combustion products.

17 Claims, 5 Drawing Figures

AUTOMATIC CHIMNEY CAP

BACKGROUND OF THE INVENTION

The well known "chimney effect" is the cause of considerable heat loss from heated buildings, particularly residences having a conventional wood-burning fireplace with a masonry or other similar chimney that is blocked off by a manually operable flue damper. When the fireplace is in use, the damper is of course open. A difficulty arises that when the fire dies out, the damper must remain open as long as there is any partial burning or smoking, which means that the damper may very easily be left in its open position long after there is no need for it to be open. Even when closed, the conventional chimney damper does not provide a particularly tight seal, and if a fire is started without first opening the damper, the dwelling space may be quickly filled with smoke before the damper may be opened.

SUMMARY OF THE INVENTION

It is an object of the present invention to overcome the above-noted disadvantages of a conventional fireplace chimney damper arrangement, specifically and in general provide for the closure of a flue that discharges smoke and combustion products from a combustion area in an automatic manner. It is a further object to perform such a function in an efficient, low maintenance, low cost and reliable manner, with built-in safety features.

Specifically, a frame is designed to be inserted into a conventional chimney top for mounting various power devices and automatic controls that will sense the presence of smoke or heat indicating combustion in a lower combustion area so as to raise a ceiling chimney cap to vent the chimney for a fixed period of time, during which the sensing device will be shielded. After this fixed time, the cap will automatically close and seal the chimney and at the same time open up the detector to the environment within the chimney, so that if combustion products or heat are still present, the chimney cap will immediately be again moved to its open position for the fixed period of time. Specific structure that is low in cost, reliable and easy to maintain and operate is further provided for such advantages.

BRIEF DESCRIPTION OF THE DRAWING

Further objects, features and advantages of the present invention will become more clear from the following detailed description of a preferred embodiment shown in the accompanying drawing, wherein.

DETAILED DESCRIPTION OF A PREFERRED EMBODIMENT

Figure 1:
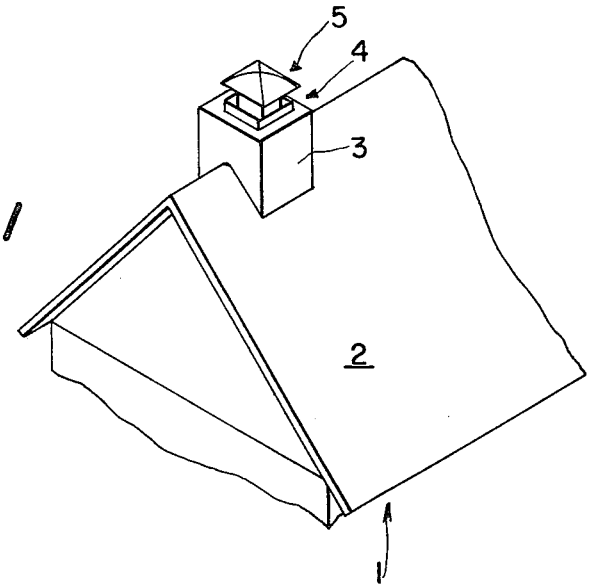
FIG. 1 is a perspective view of a dwelling, partially broken away, employing the present invention.
Figure 2:
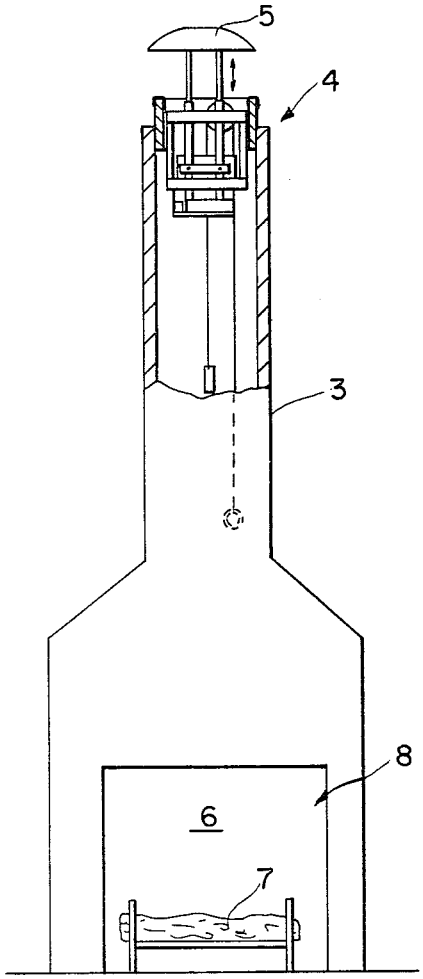
FIG. 2 is a partial cross sectional view through a conventional fireplace and chimney that is within the dwelling of FIG. 1, and showing the apparatus of the present invention installed.

As shown in FIG. 1, a residential dwelling 1 is provided with a conventional roof 2, through which passes a conventional masonry chimney 3. The upper end 4 of the chimney 3 is provided with a closure chimney cap 5, which is shown in its vent position. While the present invention may be used with different types of chimneys and different types of buildings, in its preferred form it is associated with a conventional dwelling and a chimney leading to a conventional wood-burning fireplace 6 such as that shown in FIG. 2 for the burning of a wood 7 in the combustion area 8 of the open hearth fireplace 6 for the production of heat and combustion products that will at least partially rise up through the chimney 3. With the cap 5 in the position shown in FIGS. 1 and 2, it is seen that the heat and smoke produced in the combustion area 8 will rise up through the chimney 3 and be discharged through the upper terminal end 4 of the chimney.

Figure 3:
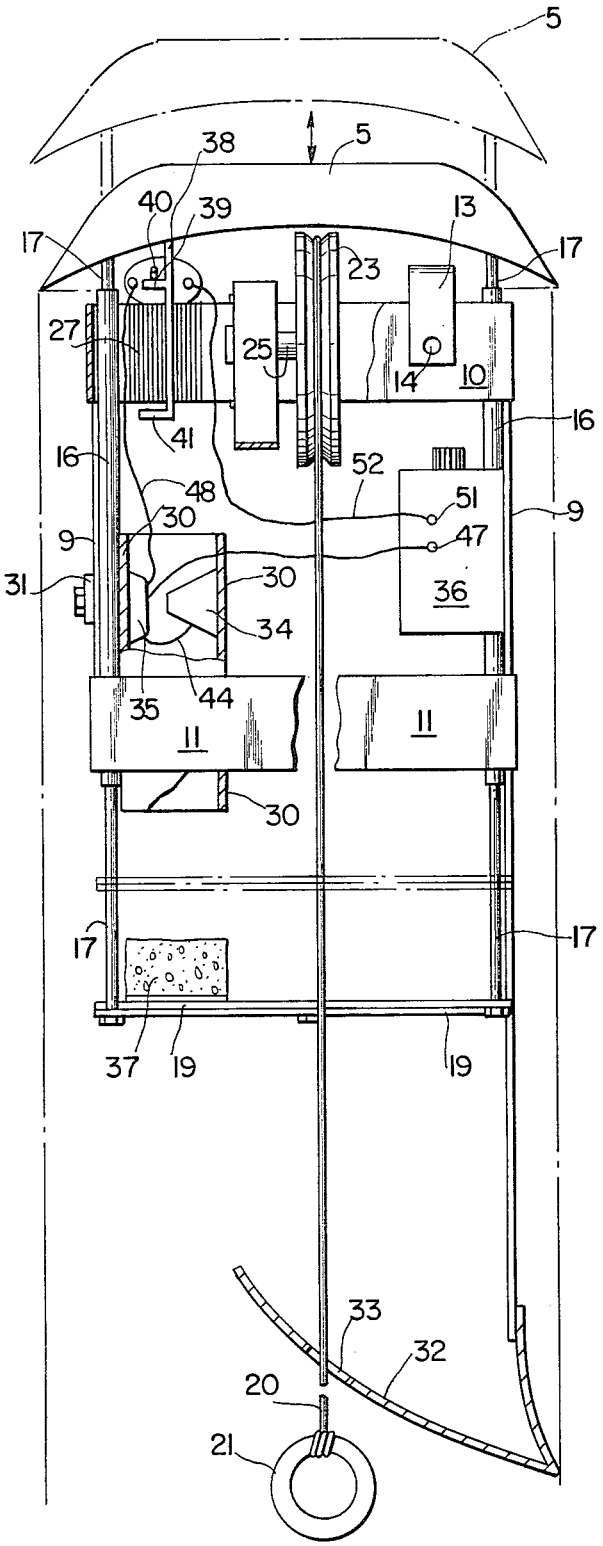
FIG. 3 is an enlarged view of the apparatus shown in FIG. 2.
Figure 4:
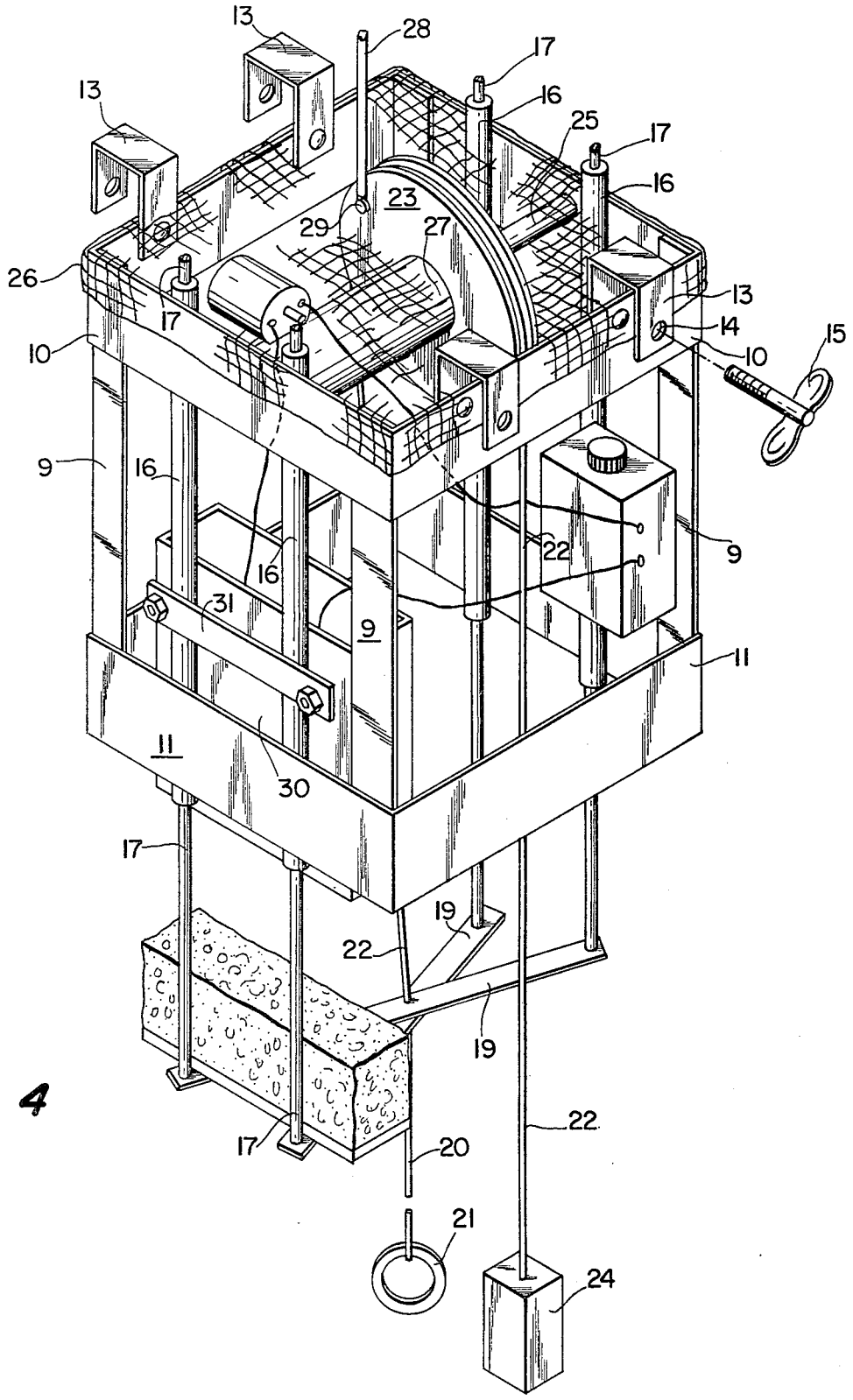
FIG. 4 is a perspective view of the apparatus shown in FIG. 3.

As shown in FIGS. 3 and 4, the apparatus includes a rigid frame comprising parallel vertical corner metal straps 9 welded, riveted or otherwise fixedly secured at their upper and lower ends to respective four-sided rigid metal ring members 10 and 11. The frame 12 composed of the members 9, 10, 11 is of a shape to fit telescopically within the upper end 4 of the chimney. Securement of the frame to the chimney is provided by inverted U-shaped securement members 13 that will extend outwardly from their rigid attachment to the ring member 10 to overlap the upper end 4 of the chimney and extend along the outside of the chimney. The outermost legs of the members 13 are provided with threaded apertures 14 that threadably receive screws 15 that may be used to clamp the frame to the upper end of the chimney. The securement members 13 function as brackets for suspending the frame within the chimney.

Four tubes 16 are fixedly secured to the frame 12 so as to extend vertically and parallel to each other. Four rods 17 are respectively telescopically and slidably received within the tubes 16. At their upper end, the rods 17 are rigidly each secured to the cap 5, so as to support the cap 5 for movement between a first position engaging the upper end of the chimney and a second position spaced upwardly from the first position so as to vent the chimney. In this manner, the cap functions as a movable valve member. The cap is specifically constructed of sheet metal formed into an upwardly convex shape that completely overlies the terminal end of the chimney above the entire frame. The cap 5 has a lower downwardly projecting peripheral sealing surface for engaging the uppermost end of the chimney upper end 4 in the first position to seal the chimney against the escape of gases as shown in FIG. 3.

while the above structure is specifically designed for rectangular chimneys, it is to be understood that the frame and cap may be also constructed so as to be received within round flues. The frame is preferably constructed of $\frac{1}{8}$ inch flat metal stock, which is cut, bent and welded into the illustrated configuration. Different size caps and frames can be constructed for different size flues, with the remaining structure being common to all such sized caps and frames. It is also contemplated that the frame could be adjustable to fit different size flues and either different size caps could be provided with such an adjustable frame or a very large cap could be provided that would be suitable for the full range of flue sizes. It is also contemplated that some type of electrical ground wire (not shown) may be provided between the frame and the ground, in a manner that is well known with respect to conventional lightening rods.

While the apparatus has an automatic system for raising and lowering the cap between its two positions, which will be described hereinafter, it is important that there be provided a manual override, so that the cap may be raised and lowered manually, if desired, or in the event of emergencies, or in the event of failure of the automatic system.

The lower ends of the rods 17 are rigidly connected together by means of two cross metal straps 19, which are welded or otherwise joined together where they cross at the center line of the chimney opening or flue. At this cross point, there is secured by any suitable means, a chain, cable or other similar flexible connector, which has a lower portion 20 that extends downwardly adjacent the combustion area to a manual handle in the form of a ring 21. By pulling on this ring 21, the lower portion 20 of the flexible connector will pull downwardly on the cross straps 19, rods 17 and thus the cap 5 to move the cap 5 to its closed first position. The upper portion 22 of the flexible connector, which is secured to the cross straps 19, extends upwardly and around the left-hand portion (FIG. 4) of a pulley 23, around the pulley 23, and downwardly from the right-hand portion of the pulley 23 to adjacent the combustion area where it is connected to a counterweight 24. The counterweight 24 is sufficiently heavy to bias the cap into its second or vent position. If it is manually necessary to move the cap to its vent position, a person reaching from the combustion area may grasp the counterweight 24 and pull downwardly on the portion 22 to rotate the pulley 23 and lift upwardly on the portion 22 that is connected to the cross straps 19, to in turn upwardly lift the cross straps 19, rods 17 and cap 5. The ring 21 and counterweight 24 are of different shapes, so that they may be distinguished by touch. The pulley 23 is mounted on a shaft 25 that is rotatably mounted, for rotation about a horizontal axis, in the frame 12, particularly the upper ring member 10.

If desired, the ring member 10 may be covered with a screening 26, so as to prevent the entry of animals into the chimney when the cap 5 is in its second vent position.

An electric motor 27 is drivingly secured to the pulley shaft 25. The motor 27 is reversable so that it may drive the pulley in a direction to lower the cap 5, or drive the pulley 23 in the opposite direction to raise the cap 5. As mentioned above, rotation of the pulley in one direction will lift up that portion of the flexible connector 22 secured to the cross straps 19 and thereby raise the cap. The left-hand portion (as seen in FIG. 4) of the pulley 23 has a cable 28 secured to it at 29; the opposite end of the cable 28 is secured to the cap (not shown in FIG. 4), so that rotation of the pulley 23 in the opposite direction (counterclockwise as shown in FIG. 4) will positively pull the cap downwardly against the upward bias of the weight 24. In this manner, the cap may be raised or lowered selectively by actuation of the motor 27 or manually by actuation of the ring 21 or counterweight 24. Of course, the motor 27 is suitably mounted to the frame 12.

Actuation of the motor is accomplished with the following structure. A rectangular shaped tube 30 is secured by means of a strap 31 fixedly to the frame, particularly by being clamped to the tubes 16. The opposite ends of the tube 30 are open. As seen in FIG. 3, a deflector plate 32 is secured to the frame 12, with a passage 33 for the flexible connectors 20, 22, and functions to direct upwardly traveling smoke, heat and combustion products to the lower end of the tube 30, so that they will travel upwardly through the tube 30 where they will be sensed by a detector 34 that will operate a relay 35, which in turn will actuate a reset timer 36 for control of the electric motor 27. When the cap moves to its open vent position, that is when the cap raises, a resilient (preferably synthetic resin sponge block) plug 37 will move upwardly, by reason of its attachment to the cross straps 19, to engage and tightly seal off the bottom opening of the tube 30, so that no further combustion products may enter the tube 30. In this manner, when the cap is in its vent position, the combustion products will not enter the tube 30 and thereby the life of the detector 34 and relay 35 will be greatly extended.

To automatically determine the position of the cap, a switch actuator 38 is rigidly secured to the cap 5 to depend from and travel with the cap 5. The actuator 38 has a first cam or switch operator 39 to actuate a single switch operator 40 for a double-throw switch when the cap is in its illustrated lowered position, and a second actuator 41 that will move the switch operator 40 in the opposite direction when the cap is raised to its vent position.

In FIG. 4, the cap and actuator 38 have been removed so as to permit viewing of the structure beneath them.

The automatic electrical controls will be described with respect to FIG. 5. The detector 34 may be of any of the well known types known and particularly used in fire detectors, which may, for example, be either a smoke detector or an incipient particle detector. In any event, the smoke detector 34 will produce a low-voltage output signal on output terminal 42, to travel through line 44 to the input terminal 43 of a conventional relay 35. A low-voltage signal in line 44 will produce a high-voltage signal at output terminal 45 of the relay 35. The signal at terminal 45 is split at junction 46 so as to first travel to the terminal 47 of a motor operated reset timer 36, and also travel through line 48 to contact 49 of a double-pole, double-throw, toggle switch 50 that has actuator 40. The reset timer 36, for example, is of the type wherein there is automatic reset, synchronous motor-driven, plug-in timing control for a controlled period of time, actuated by an external signal, for example, the series G P "Plug-In Automatic Reset Interval/Delay Timer", described in Bulletin 312 manufactured by Industrial Timer Corporation of New Jersey and sold by Technical Distributors, Incorporated, 5115 Franconia Rd., Arlington, Va. At the end of the timing interval, for example, four hours, the reset timer 36 will have internal contacts that will close thus allowing current flow from its input terminal 47 to its output terminal 51; that is, four hours after receipt of a signal at its input terminal 47, the reset timer will produce an output signal at its output terminal 51. The output signal of the reset timer 36 travels from its output terminal 51 through line 52 to the contact 53 of switch 50. The electric motor 27 has a terminal 54, which when excited will rotate the motor so as to raise the cap 5, and a down terminal 55, which when excited will rotate the motor to lower the cap. The motor also has a common power terminal 56, which in this case leads to ground.

OPERATION

Although most of the operation is clear from the above description, portions of the operation will be briefly described below.

Figure 5:
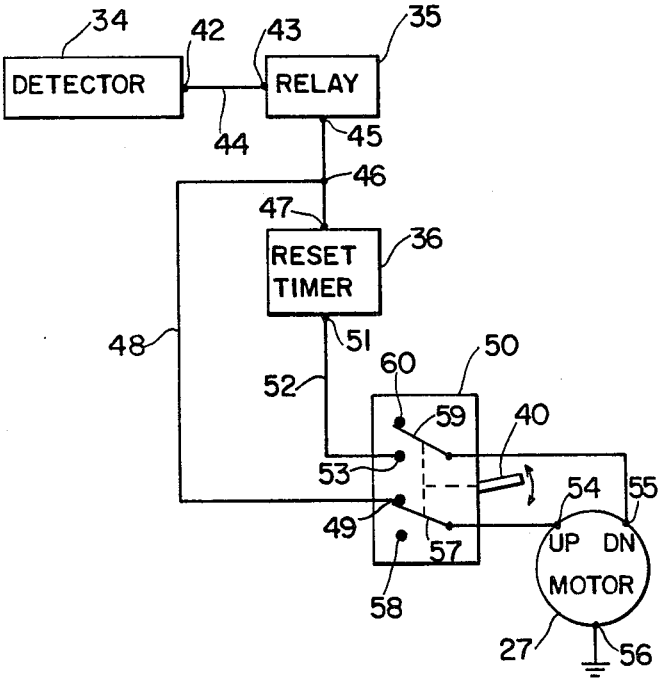
FIG. 5 is a schematic illustration of the electrical controls for the apparatus.

Assuming that the cap 5 is in the down closed position wherein it seals the upper end of the chimney 3, the switch 50 will be in the position illustrated in FIG. 5. When combustion takes place in the combustion area 8, combustion gases, including hot gases and smoke will rise in the chimney 3, and as shown by the arrows in FIG. 3, they will enter the open tube 30 where heat, smoke or incipient particles will be detected by the detector 34, to produce a low-voltage output signal at the output terminal 42 of the detector 34. This signal, received at the input terminal 43 of the relay 35, will produce a high-voltage signal at the output terminal 45 of the relay 35. This output signal will simultaneously be applied to the input terminal 47 of the reset timer and to the terminal 49 of the switch 50. The receipt of the signal at the input terminal 47 of the reset timer will start the timing cycle of the reset timer. The signal at the terminal 49 of the switch 50 will be fed through contact 57 to the up terminal 54 of the motor to raise the cap. After the cap reaches its upper vent position, the actuator 41 will strike the switch operator 40 to move the contact 57 to neutral terminal 58 and move the contact 59 from a neutral terminal 60 to the terminal 53. At this point, the motor will stop, the cap will remain in its vented position, and no current will flow through the motor, because the internal contacts of the reset timer 36 are open. After the passage of the fixed timing period of the reset timer 36, for example, four hours, the internal contacts of the reset timer 36 will close and permit the signal from the input terminal 47 to pass to the output terminal 51, through line 52, from contact 53 through switch contact 59 to the down terminal 55 of the motor, to actuate the motor 27 to drive the cap to its lower position. Upon reaching its lower position, the actuator 39 will strike the switch actuator 40 to again move the contacts 57, 59 to their position illustrated in FIG. 5. As noted previously, the detector will be shielded by the shielding tube 30 and closure plug 37 when the cap is in its vented position, so that when the above-mentioned controls again close the cap, the detector will detect the presence of any smoke, incipient particles, or heat, as desired, and if the same is present, the cycle will be repeated to again open the cap; on the contrary, if smoke, incipient particles or heat is not present, the cap will remain closed. The relay 35 has a built-in hold circuit, which will operate as follows: When a signal is being received at input terminal 43, the relay 35 will, of course, remain closed to provide a high-voltage output at its output terminal 45, which condition will exist until shortly after the cap has reached its vented position. After there are no longer combustion products in the chimney or conceivably even if combustion products are present and the detector 30 no longer produces a signal because of the shielding produced by the tube 30 and plug 37, the detector will not provide a signal at input terminal 43, but the relay 35 will continue to produce an output 45 due to a conventional hold circuit so that current will continue to pass to the reset timer even though the contacts 57, 59 have moved away from their illustrated position in FIG. 5; after the reset timer closes at the expiration of its fixed timing period, current will continue to flow through the relay, reset timer, contacts within reset timer 36, contact 59 and motor until such time as the cap 5 reaches its lower position. At this time, the switch 50 will have its contacts moved to the position illustrated in FIG. 5, which will momentarily break the circuit through the relay and drop the hold, so that the relay contacts will open and they will not close again until such time as a signal is received from the detector 34 at the input terminal 43 of the relay 35.

While a preferred embodiment of the present invention has been illustrated in detail for the basic principles of the present invention and the advantages of the specific structure, further embodiments, variations and modifications are all contemplated within the broader aspects of the present invention, all as determined by the spirit and scope of the following claims.

What is claimed is:

1. An automatic chimney closure cap for use in sealing the upper end of a chimney having a vertically extending smoke passage leading from a combustion area that when operating will produce hot combustion gases to an upper terminal discharge end, comprising:

a rigid frame of a size and shape to fit telescopically within the chimney upper end, and having securement means for rigidly fixing the frame to the chimney;

a generally impervious movable valve member mounted for movement relative to said frame so as to be movable from a first position sealing the terminal discharge end of said chimney to prevent the movement of air into and out of said chimney through said terminal discharge end, and a second position spaced from said first position to vent the terminal discharge end of said chimney to provide for the exhaust of the combustion gases from the combustion area;

an electrical motor means mounted on said frame, having a control signal input for selected actuation and a power output;

power transmission linkage means between said motor power output and said movable valve member so that actuation of said motor will move said movable valve member from one of its said positions to the other of its said positions;

detector means mounted on said frame within said chimney between said combustion area and said movable valve member for detecting smoke or incipient particles of combustion gases and producing a correlated detection signal when such exceed a fixed reference level;

power means responsive to a control signal for moving said movable valve member from said other position to said one position;

control means responsive to said detector signal to produce a control signal for actuation of one of said power means and said motor means to move said movable valve member from its sealed first position to its vent second position;

shield means mounted on said frame for movement from a detect position spaced from said detector means that permits smoke and heat from the combustion gases rising in said chimney to reach said detector means and a second shield position at least partially enveloping said detector means and shielding said detector means from heat and smoke passing through said chimney; and means interconnecting said shield means with said movable valve member so that said shield means will be in its shield position when said movable valve member is in its vent second position and said shield means will be in its detect position when said movable valve is in its sealed first position.

2. The apparatus of claim 1, further including means producing a control signal for energizing one of said power means and said motor means for moving said movable valve member from its vent second position with the shield means shielding the detector means towards its sealed first position to unshield said detector means at a fixed time after said movable valve member has reached its vent second position so that said detector means may detect the presence or absence of heat or combustion products in the chimney.

3. The apparatus of claim 2, wherein said detector means includes a smoke or heat-sensitive detection element fixedly mounted within a vertically extending tube having its opposite ends open so that smoke and heat rising within said chimney may vertically pass through said tube and control the operation of said detection element, and said shield means includes a member movable from a position spaced below the lower open end of said tube and a position resiliently engaging the entire periphery of the lower open end of said tube.

4. An automatic chimney closure cap for use in sealing the upper end of a chimney having a vertically extending smoke passage leading from a combustion area that when operating will produce hot combustion gases to an upper terminal discharge end, comprising:

a rigid frame of a size and shape to fit telescopically within the chimney upper end, and having securement means for rigidly fixing the frame to the chimney;

a generally impervious movable valve member mounted for movement relative to said frame so as to be movable from a first position sealing the terminal discharge end of said chimney to prevent the movement of air into and out of said chimney through said terminal discharge end, and a second position spaced from said first position to vent the terminal discharge end of said chimney to provide for the exhaust of the combustion gases from the combustion area;

an electrical motor means mounted on said frame, having a control signal input for selected actuation and a power output;

power transmission linkage means between said motor power output and said movable valve member so that actuation of said motor will move said movable valve member from one of its said positions to the other of its said positions;

detector means mounted on said frame within said chimney between said combustion area and said movable valve member for detecting smoke or incipient particles of combustion gases and producing a correlated detection signal when such exceed a fixed reference level;

power means responsive to a control signal for moving said movable valve member from said other position to said one position;

control means responsive to said detector signal to produce a control signal for actuation of one of said power means and said motor means to move said movable valve member from its sealed first position to its vent second position; and manual override means drivingly connected to said movable valve member for moving said movable valve member from its sealed first position to its vent second position, and having a downwardly depending elongated control mechanical linkage for extending from the frame downwardly through the chimney to the combustion area where it may be manually operated.

5. The apparatus of claim 4, said manual override means including a pulley fixedly secured to said motor output, and a cable secured to said pulley and extending downwardly into the combustion area so that a pulling force on said cable will rotate said pulley.

6. The apparatus of claim 1 wherein said frame securement means includes a plurality of brackets for extending upwardly beyond the terminal discharge end of the chimney and then outwardly to overlap the terminal discharge end of said chimney for supporting said frame within the chimney.

7. The apparatus of claim 6, said securement means further including a plurality of threaded fasteners extending through said bracket means for clamping engagement with the outer periphery of the chimney terminal end.

8. The apparatus of claim 1, said movable valve member being a cap having an upper outer surface that is convex and completely overlies the terminal discharge end of the chimney above the entire frame, and having a lower downwardly projecting peripheral sealing surface inwardly spaced from its outer terminal edge for engaging with the upper end of the terminal discharge end of the chimney.

9. The apparatus of claim 8, including said frame having a plurality of parallel vertically extending fixed tubes and said chimney cap having a plurality of parallel vertically extending and downwardly depending rods telescopically received within said tubes to provide parallel guides for controlling the movement of said chimney cap as it moves between its two positions.

10. An automatic chimney closure cap for use in sealing the upper end of a chimney having a vertically extending smoke passage leading from a combustion area that when operating will produce hot combustion gases to an upper terminal discharge end, comprising:

a rigid frame of a size and shape to fit telescopically within the chimney upper end, and having securement means for rigidly fixing the frame to the chimney;

a generally impervious movable valve member mounted for movement relative to said frame so as to be movable from a first positition sealing the terminal discharge end of said chimney to prevent the movement of air into and out of said chimney through said terminal discharge end, and a second position spaced from said first position to vent the terminal discharge end of said chimney to provide for the exhaust of the combustion gases from the combustion area;

an electrical motor means mounted on said frame, having a control signal output for selected actuation and a power output;

power transmission linkage means between said motor power output and said movable valve member so that actuation of said motor will move said movable valve member from one of its said positions to the other of its said positions;

detector means mounted on said frame within said chimney between said combustion area and said movable valve member for detecting at least one of heat and combustion gases and producing a correlated detection signal when such exceed a fixed reference level;

power means responsive to a control signal for moving said movable valve member from said other position to said one position;

control means responsive to said detector signal to produce a control signal for actuation of one of said power means and said motor means to move said movable valve member from its sealed first position to its vent second position; and shield means mounted on said frame for movement from a detect position spaced from said detector means that permits smoke and heat from the combustion gases rising in said chimney to reach said detector means and a second shield position at least partially enveloping said detector means and shielding said detector means from heat and smoke passing through said chimney, and including means interconnecting said shield means with said movable valve member so that said shield means will be in its shield position when said movable valve member is in its vent second position and said shield means will be in its detect position when said movable valve is in its sealed first position.

11. The apparatus of claim 10, further including means producing a control signal for energizing one of said power means and said motor means for moving said movable valve member from its vent second position with the shield means shielding the detector means towards its sealed first position to unshield said detector means at a fixed time after said movable valve member has reached its vent second position so that said detector means may detect the presence or absence of heat or combustion products in the chimney.

12. The apparatus of claim 11, wherein said detector means includes a smoke or heat-sensitive detection element fixedly mounted within a vertically extending tube having its opposite ends open so that smoke and heat rising within said chimney may vertically pass through said tube and control the operation of said detection element, and said shield means includes a member movable from a position spaced below the lower open end of said tube and a position resiliently engaging the entire periphery of the lower open end of said tube.

13. The apparatus of claim 12, including manual override means drivingly connected to said movable valve member for moving said movable valve member from its sealed first position to its vent second position, having a downwardly depending elongated control mechanical linkage for extending from the frame downwardly through the chimney to the combustion area where it may be manually operated, and further including a pulley fixedly secured to said motor output and a cable secured to said pulley and extending downwardly into the combustion area so that a pulling force on said cable will rotate said pulley.

14. An automatic chimney closure cap for use in sealing the upper end of a chimney having a vertically extending smoke passage leading from a combustion area that when operating will produce hot combustion gases to an upper terminal discharge end, comprising:

a rigid frame of a size and shape to fit telescopically within the chimney upper end, and having securement means for rigidly fixing the frame to the chimney;

a generally impervious movable valve member mounted for movement relative to said frame so as to be movable from a first position sealing the terminal discharge end of said chimney to prevent the movement of air into and out of said chimney through said terminal discharge end, and a second position spaced from said first position to vent the terminal discharge end of said chimney to provide for the exhaust of the combustion gases from the combustion area;

an electrical motor means mounted on said frame, having a control signal input for selected actuation and a power output;

power transmission linkage means between said motor power output and said movable valve member so that actuation of said motor will move said movable valve member from one of its said positions to the other of its said positions;

detector means mounted on said frame within said chimney between said combustion area and said movable valve member for detecting at least one of heat and combustion gases and producing a correlated detection signal when such exceed a fixed reference level;

power means responsive to a control signal for moving said movable valve member from said other position to said one position;

control means responsive to said detector signal to produce a control signal for actuation of one of said power means and said motor means to move said movable valve member from its sealed first position to its vent second position; and manual override means drivingly connected to said movable valve member for moving said movable valve member from its sealed first position to its vent second position, and having a downwardly depending elongated control mechanical linkage for extending from the frame downwardly through the chimney to the combustion area where it may be manually operated.

15. The apparatus of claim 14, said manual override means including a pulley fixedly secured to said motor output, and a cable secured to said pulley and extending downwardly into the combustion area so that a pulling force on said cable will rotate said pulley.

16. An automatic chimney closure cap for use in sealing the upper end of a chimney having a vertically extending smoke passage leading from a combustion area that when operating will produce hot combustion gases to an upper terminal discharge end, comprising:

a rigid frame of a size and shape to fit telescopically within the chimney upper end, and having securement means for rigidly fixing the frame to the chimney;

a generally impervious movable valve member mounted for movement relative to said frame so as to be movable from a first position sealing the terminal discharge end of said chimney to prevent the movement of air into and out of said chimney through said terminal discharge end, and a second position spaced from said first position to vent the terminal discharge end of said chimney to provide for the exhaust of the combustion gases from the combustion area;

an electrical motor means mounted on said frame, having a control signal input for selected actuation and a power output;

power transmission linkage means between said motor power output and said movable valve member so that actuation of said motor will move said movable valve member from one of its said positions to the other of its said positions;

detector means mounted on said frame within said chimney between said combustion area and said movable valve member for detecting at least one of heat and combustion gases and producing a correlated detection signal when such exceed a fixed reference level;

power means responsive to a control signal for moving said movable valve member from said other position to said one position;

control means responsive to said detector signal to produce a control signal for actuation of one of said power means and said motor means to move said movable valve member from its sealed first position to its vent second position; and means producing a control signal for energizing one of said power means and said motor means for moving said movable valve member from its vent second position towards its sealing first position automatically at a fixed time after said movable valve member has reached its vent second position.

17. The apparatus of claim 16, including means for disabling said detector means automatically when said movable valve member is in its sealing first position to prevent the producing of said detection signal, and for automatically enabling said detector means to be operative to produce said detection signal when said movable valve member is in its vent second position.

* * * * *

UNITED STATES PATENT AND TRADEMARK OFFICE

CERTIFICATE OF CORRECTION

PATENT NO. : 4,256,257

DATED : March 17, 1981

INVENTOR(S) : Carl A. Pinkerton

It is certified that error appears in the above—identified patent and that said Letters Patent is hereby corrected as shown below:

On The Title Page Item (76) "6093 Northgap Rd.
Columbus, Ohio 43229"

should read -- 892 Litchfield Court
Worthington, Ohio 43085 --.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*